US005884119A

United States Patent [19]

Maruo et al.

[11] Patent Number: 5,884,119

[45] Date of Patent: Mar. 16, 1999

[54] LIGHT EXPOSURE CONTROLLING METHOD OF ELECTROPHOTOGRAPHIC APPARATUS FOR SUPPRESSING FRINGE IN PICTURE

[75] Inventors: Seiji Maruo, Hitachinaka; Hisao Okada, Hitachi; Hiroyuki Mabuchi, Hitachinaka; Kazutoshi Obara, Hitachinaka; Kenichi Ito, Hitachinaka, all of Japan

[73] Assignees: Hitachi, Ltd.; Hitachi Koki Co., Ltd., both of Tokyo, Japan

[21] Appl. No.: 895,032

[22] Filed: Jul. 16, 1997

[30] Foreign Application Priority Data

Jul. 24, 1996 [JP] Japan ..... 8-194330

[51] Int. Cl.[6] ..... G03G 15/043

[52] U.S. Cl. ..... 399/51; 399/52

[58] Field of Search ..... 399/38, 39, 51, 399/182, 187, 191, 222, 223, 231, 232

[56] References Cited

U.S. PATENT DOCUMENTS

| | | | |
|---|---|---|---|
| 5,061,969 | 10/1991 | Parker et al. | 399/232 |
| 5,241,359 | 8/1993 | Williams | 399/232 |
| 5,500,727 | 3/1996 | Maruyama et al. | 399/39 |

*Primary Examiner*—Arthur T. Grimley
*Assistant Examiner*—Hoan Tran
*Attorney, Agent, or Firm*—Antonelli, Terry, Stout & Kraus, LLP

[57] ABSTRACT

In the tri-level process in which positive and negative latent images are formed on a photosensitive body and then developed using toners of two colors (for example, red and black) charged respectively to opposite polarities with respect to the polarities of the latent images, there has been a problem of degrading the quality of a two-color picture by the appearance of a special phenomenon in which red toner is attached around a black image and black toner is attached around a red image by attraction of the reverse electric field. An exposure control is performed in order to suppress the fringe phenomenon.

6 Claims, 14 Drawing Sheets

| DRIVER SELECT SIGNAL | SWITCHING SIGNAL 1 | SWITCHING SIGNAL 2 | SWITCHING SIGNAL 3 |
|---|---|---|---|
| 00 | 1 | 0 | 0 |
| 01 | 0 | 1 | 0 |
| 10 | 0 | 0 | 1 |

0 : DRIVER OFF 1 : DRIVER ON

LIGHT EXPOSURE CONTROLLING METHOD OF ELECTROPHOTOGRAPHIC APPARATUS FOR SUPPRESSING FRINGE IN PICTURE

BACKGROUND OF THE INVENTION

The present invention relates to a method of controlling the quantity of laser beam light emitted by a semiconductor scanning apparatus of the type used for a writing-in head in a laser beam printer, a digital copy machine and the like, and more particularly, the invention relates to a method of controlling the quantity of light in an electrophotographic apparatus employing a tri-level developing method in which normal and reverse latent images are formed, preferably by a single exposure, and in which two-color development is performed.

A conventional laser printer typically uses one laser scanning light beam and one-color toner for development. However, in recent years, a tri-level developing method has attracted attention as being applicable for use in a laser printer for color printing. For example, such a tri-level developing method is disclosed in U.S. Pat. No. 4,847,655. The tri-level developing method is a method in which one laser scanning light beam forms a normal developed latent image, a reverse developed latent image and an intermediate voltage latent image, which is not performed with either of the other developments, and then a development using toners of two colors is performed at one time.

In an electrophotographic process, when an electrostatic latent image is formed on a photosensitive body, an electric field having a polarity opposite to the polarity of the latent image is formed in a peripheral portion of the latent image, together with an electric field enhancing development formed at the edge portion of the latent image.

The reverse electric field is not a problem in the forming of an image in a conventional one-color development process. However, in the tri-level process in which positive and negative latent images are formed on a photosensitive body and then are developed using toners of two colors (for example, red and black) charged respectively to polarities opposite to the polarities of the latent images, there has been a problem of degraded quality of the two-color picture by appearance of a special phenomenon (hereinafter referred to as a "fringe phenomenon") in which red toner is attached around a black image and black toner is attached around a red image by attraction of the reverse electric field.

SUMMARY OF THE INVENTION

In accordance with the present invention, exposure control is performed in order to suppress the fringe phenomenon, and a means for detecting a fringe appearance zone and a means for performing compensation exposure is provided in order to realize the exposure control.

As a characteristic of the fringe image, the fringe sometimes appears in the order of several hundreds of micromillimeters depending on the developing condition or image pattern. This phenomenon affects the means for detecting the fringe appearance zone. In a system in which light quantity compensation is performed by distinguishing between a normal thin line and a fully-solid image, for example, where a fully-solid image portion is intensely exposed, it is sufficient to distinguish several dots around objective pixels. However, in order to perform the fringe control, several tens of lines of memory are required.

In accordance with the present invention, there is provided an image information storage which stores specific characteristics of the fringe phenomenon for use in exposure control.

DETAILED DESCRIPTION OF THE PREFERRED EMBODIMENTS

Figure 10:
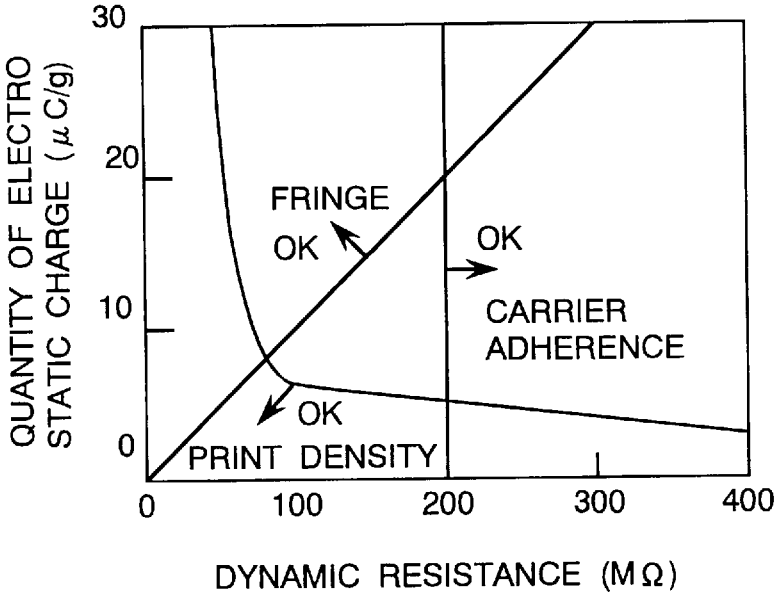
FIG. 10 is graph showing an inter-relationship among density, carrier attachment and fringe.

Before describing an embodiment of the present invention, the inevitability of performing exposure control to solve the fringe problem will be briefly described. The most important problem in performing tri-level development involves a trade-off in the relationship among fringe, carrier attachment and print density, which are necessary conditions to satisfy the development process. FIG. 10 shows an inter-relationship among the print density, carrier attachment and fringe obtained as an experimental result (ferrite and magnetite are used as a base material of the toner carrier).

FIG. 10 shows a domain where each of the conditions are satisfied by taking the dynamic resistivity of a developing agent (resistivity of the developing agent measured in the developing state) along the abscissa and the quantity of charge on the toner along the ordinate. It can be understood from the figure that there is no state of the developing agent satisfying all three conditions.

If there is no countermeasure to achieve a more satisfactory condition to reduce fringe independently of the trade-off of the three conditions (from outside of the trade-off), one might consider the use of a developing agent having a very small dynamic resistivity, while totally sacrificing, for example, carrier attachment. However, in such a case, there is a negative effect on the total system, such as an increased problem of recovering dispersed carrier, a degradation of the life-time of the developing agent and so on. Therefore, it is best to maintain the present system, if possible, rather than adopt a technique that will only produce more problems.

The biggest advantage of exposure control is that the condition in which fringe is reduced can be achieved from outside of the trade-off. In this regard, as will be described later, fringe can be moderated by nearly 50% employing exposure control. By distributing the margin obtained here to the other conditions, the conditions for tri-level development may be satisfied while maintaining the present system as it is. Thus, it can be understood that exposure control is an essential technology for realizing tri-level development without using any special developing system.

Figure 1:
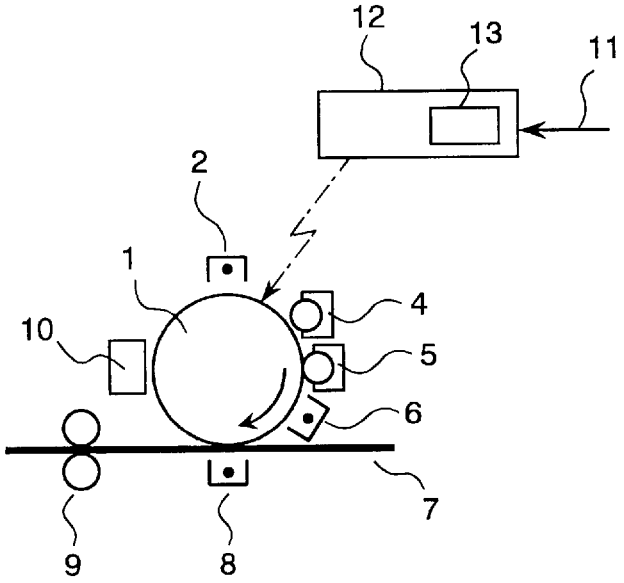
FIG. 1 is a diagram showing the overall construction of the present invention.

The overall construction of the present invention will be described with reference to FIG. 1. In a laser printer, a photosensitive drum 1 is uniformly charged by a charger 2, and then a latent image is formed by an exposure control unit 12. After that, the latent image is developed by toners of two colors using two developing units 4, 5 through a tri-level development process to be described later. Since the toners of two colors to be developed are different in charge polarity from each other, a pre-charger unit 6 is used for bringing the polarities to the same polarity prior to image transfer. The toners of two colors are transferred onto a sheet of paper 7 by a transferring unit 8, and then the toner is melt-fixed on the sheet of paper 7 by a fixing unit 9.

Remaining toner is then recovered by a cleaner 10, and thus the process is completed. In this process, a fringe correcting means 13, according to the present invention, is installed in the exposure control unit 12 and is operated according to an input image signal from a host side.

Figure 2:
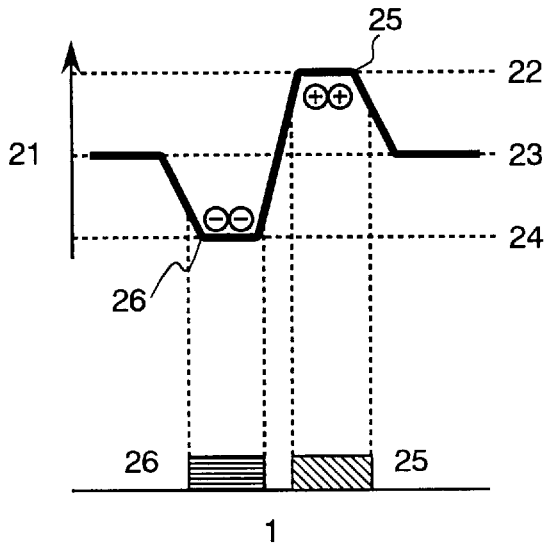
FIG. 2 is a waveform diagram explaining the tri-level phenomenon.

The standard process of tri-level development will be described below, referring to FIG. 2. By controlling the light exposure in two steps and controlling the electric potential 21 on a surface of the photosensitive body in three levels, an unexposed electric potential (positively charged toner electric potential 22) portion to be developed with positively charged toner 25 (normal development), a strongly exposed electric potential (negatively charged toner electric potential 24) portion to be developed with negatively charged toner 26 (reverse development) and a weak exposed portion of white electric potential 23 not to be developed with either of the toners are formed.

Figure 3A:
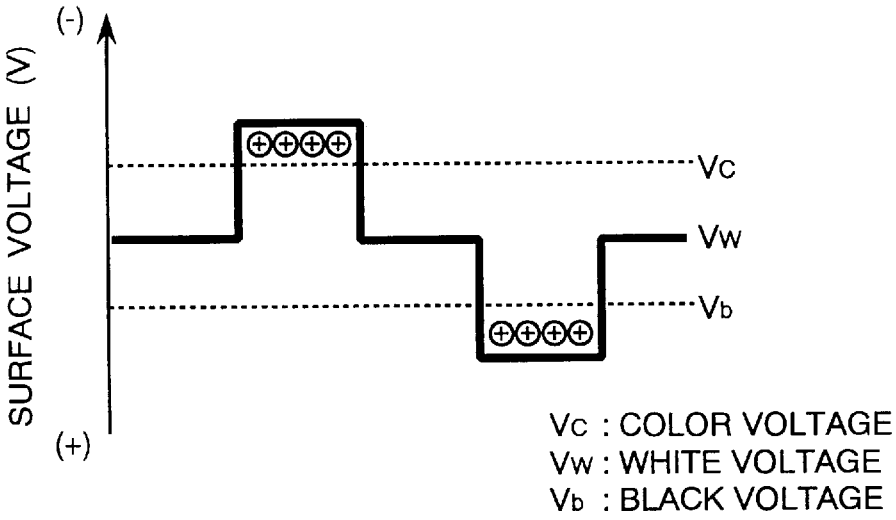
FIGS. 3A and 3B are diagrams showing the surface electric potential and surface electric field on a photosensitive body after exposure.
Figure 3B:
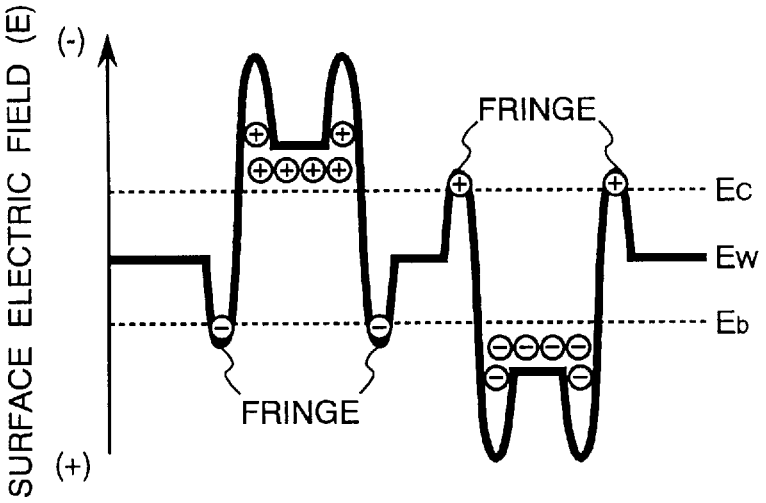

The occurrence of fringe, which represents a main subject of this invention, now will be explained. FIG. 3A shows the surface electric potential and FIG. 3B shows the surface electric field on a photosensitive body after exposure. The figures represent an example in which exposure of a light beam is performed from a strongly exposed portion (reverse developed portion) to a weakly exposed portion (white portion). From the viewpoint of electric potential, binary development is performed with surface electric potentials of the developing biases Vc, Vb, and therefore there seems to be no problem. However, the development is actually performed through an electric field obtained by differentiating the electric potential, as seen in FIG. 3B.

It can be understood from the diagram of the surface electric field, as seen in FIG. 3B, that an enhancement of the electric field appears in a changing portion of the image. Since in the past only a reverse or normal development was performed, the electric field enhancement at the edge portion resulted only in an edge enhancement in a developed image. However, in the tri-level development process, there appears a phenomenon in which the reverse electric field produced in a white portion develops an opposite side color around a necessary image (fringe development).

Figure 4A:
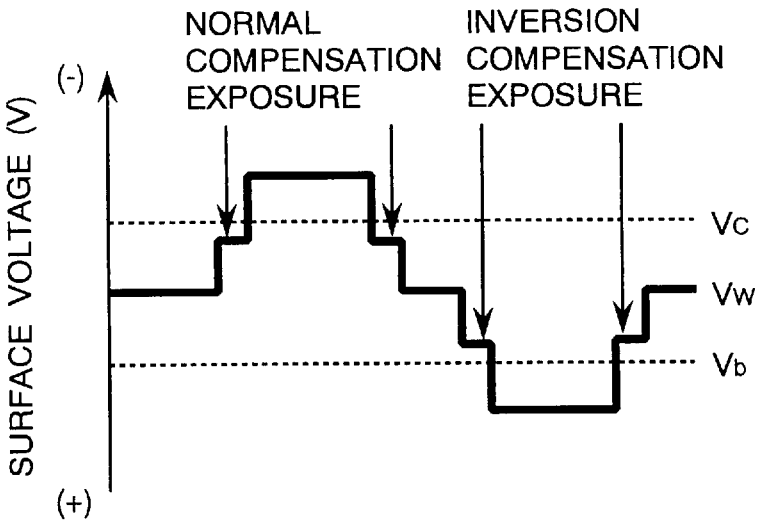
FIGS. 4A and 4B are diagrams for explaining exposure control.
Figure 4B:
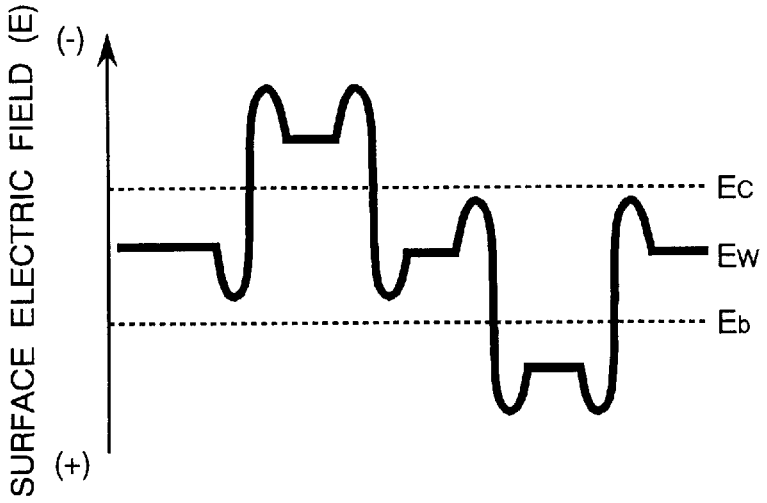

FIGS. 4A and 4B illustrate how exposure control can be used to solve the above problem. An object of the exposure control is to moderate the electric intensity (electric potential gradient) around an image by controlling light exposure and ideally forming the electric field distribution to a shape of the surface electric field of the photosensitive body, as shown in FIG. 3A by analogously and finely controlling the exposure depending on the position of the exposure.

However, a high speed analogue exposure control is required in order to realize the above-mentioned control, and accordingly it is difficult to directly apply the above control method to actual products. An embodiment of a simple control method applicable to use in actual products will be described. In detail, by controlling the electric potential around an image in a step shape, as exemplified by the surface electric potential of the photosensitive body shown in FIG. 4A, the electric field around the image can be weakened, as exemplified by the surface electric field of the photosensitive body shown in FIG. 4B, and consequently, the surface electric field of the photosensitive body can be improved to such an extent that fringe development does not appear.

According to this method, the construction of the control circuit is simple, since the number of compensation exposure levels is few, and the control method is practical, since harmonic wave dividing control for a dot is not required when the method is applied to a high speed printer. Further, as described above, FIG. 4A shows an embodiment in which the surface electric potential is controlled in a step shape. However, it is ideal to perform analogue exposure control corresponding to an image pattern having a fringe development electric field to be eliminated if a hardware construction of the system is available. This is an effective method for a low speed printer in which the control frequency is not a problem.

Figure 5A:
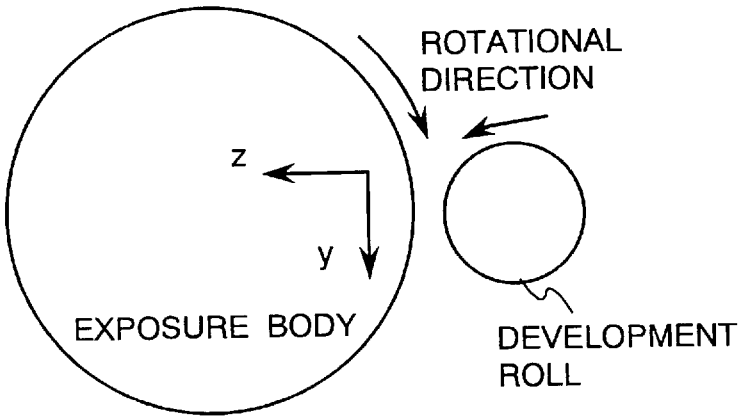
FIGS. 5A and 5B are diagrams for explaining a state of appearance of a fringe around a fully-solid image.
Figure 5B:
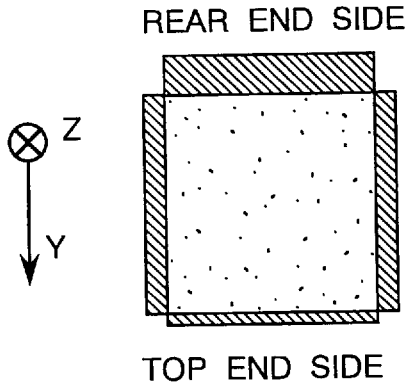

FIG. 5B shows an example of the appearance of a fringe around a fully-solid image in connection with the above method. Toner composed of a developing agent attached on the top end portion of a brush is developed from a developing roll to a photosensitive body. At that time, a force acting on the toner near the surface of the photosensitive body is important. As seen in FIG. 5A, the photosensitive body and the developing roll are rotated in the same direction. It has been clarified from a result of an experiment conducted by the inventors that, at that time, forces mainly acting on the fringe, among forces acting on the toner, are a product of the quantity of charge on the toner and an electric field qE acting as an electric field force and a scraping force FR produced by the brush of the developing agent. In such a case, the state of appearance of the fringe is different depending on the front end side or the rear end side with respect to the rotating direction, as shown in FIG. 5B. This is caused by the fact that the scraping force FR acts strongly in connection with the appearance of fringe, and the force balance of the product of the quantity of charge on the toner and an electric field qE combined with the scraping force is dominant in the appearance of fringe.

It has been clarified from a result of an experiment that a condition to eliminate the fringe can be obtained when the value (FR+qEy)/qEz is within the range of 6–10. By establishing this condition, it is possible to predict the state of appearance of fringe by calculating the scraping force and to employ a countermeasure in advance even if the developing agent is changed or the developing condition, such as development, doctor-gap or the like, is changed.

Figure 6:
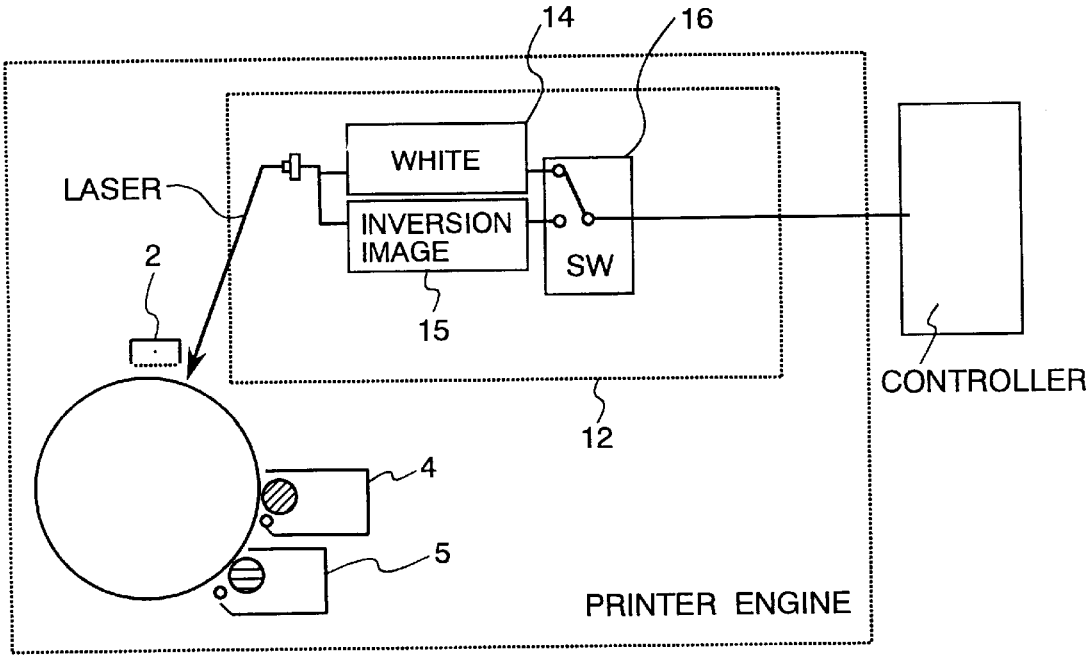
FIG. 6 is a diagram showing the construction of a conventional control circuit.

FIG. 6 shows the construction of an example of a conventional exposure control unit in which data input from a host unit is output to a printer engine. Tri-levels of surface electric potentials on the photosensitive body required for the tri-level development are realized by operating a switch 16 connected to two laser drivers 14, 15. In more detail, one driver 15 takes charge of the electric potential for the reverse image and the other driver 14 takes charge of the intermediate electric potential, and the surface electric potential of the photosensitive body becomes the normal developing electric potential when the drivers are not operated.

Figure 7:
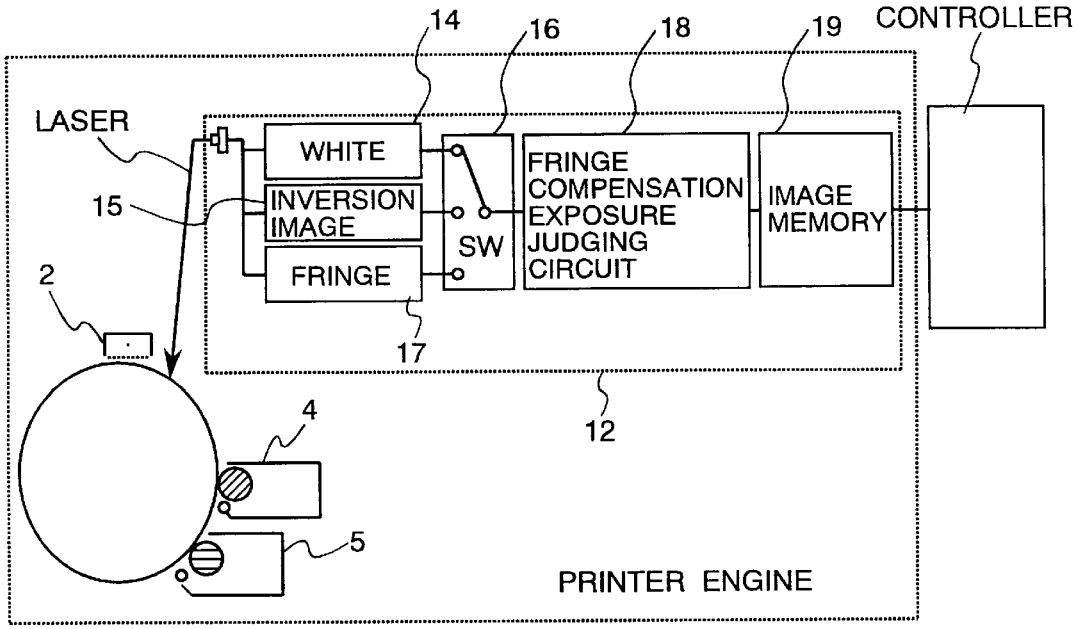
FIG. 7 is a diagram showing the construction of an embodiment of a control circuit in accordance with the present invention.

FIG. 7 shows the construction of an embodiment of a control circuit in accordance with the present invention. In this embodiment, the fringe is suppressed by exposure control. A dedicated laser driver 17 is added for the purpose of exposure control, data input from a host unit is stored in an image memory 19, and a fringe compensation judging circuit 18 for judging a condition to operate the driver 17 for fringe compensation is provided.

Figure 11:
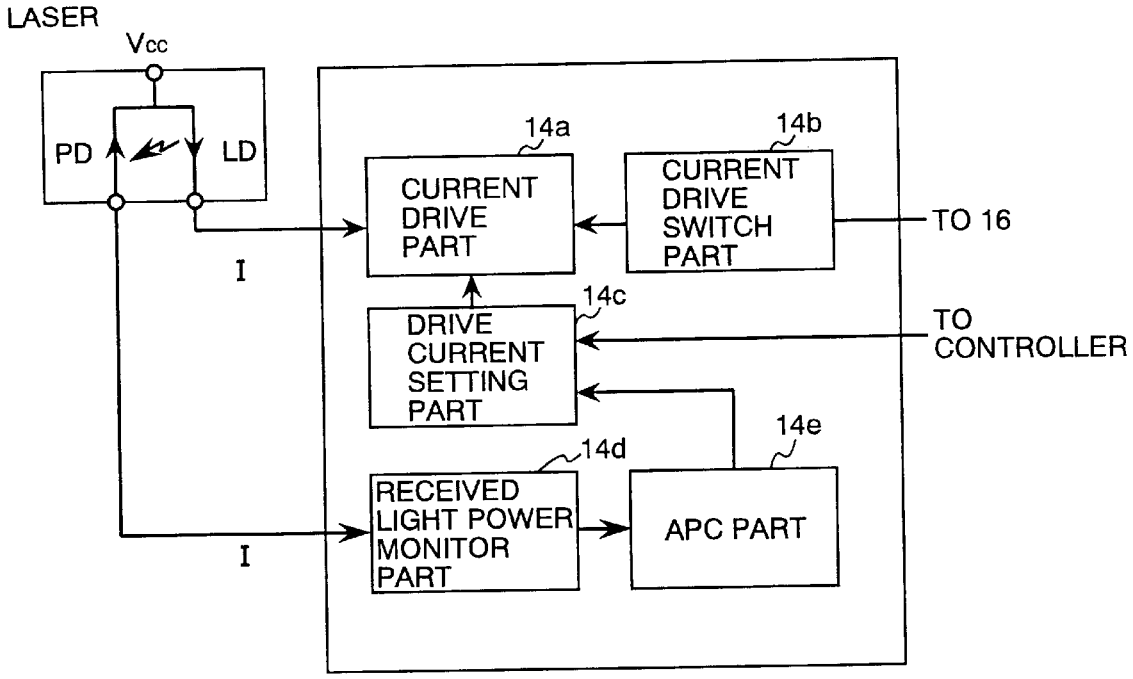
FIG. 11 is a block diagram of the laser driver shown in FIG. 7.

FIG. 11 shows more details of the laser driver employed as the laser drivers 14, 15, 17. The laser is a package which has three I/F pins, as generally known, consisting of a photo detector PD for a laser diode LD (Vcc:+5V), wherein LD which will emit light in response to a current flowing therein, and the luminescence power is monitored by the photo detector PD. A current drive unit 14*a* conducts a current, set by a drive current setting unit 14*c*, from the laser diode LD. A current drive switch unit 14*b* sends an on-off signal for current flow to the current drive 14*a* according to the picture signal via switch SW16. A luminescence power monitor 14*d* detects the luminescence power by comparing the electrical voltage obtained after I/V converting the photo-electric current received from the photo detector PD. An auto-power control unit 14*e* receives the signal indicating the luminescence light power and revises the change in the LDno luminescence characteristic caused by the environment, and the output value of the drive current setting adjuster 14*c* is compensated by the change.

The initial set value of the drive current setting unit 14*c* is set by a controller according to intended use. By having to control the unit 14*c* with the controller, if any characteristic change caused by degradation needs to be monitored, it can be fed back so as to make the control as accurate as possible.

Figures 12A, 12B:
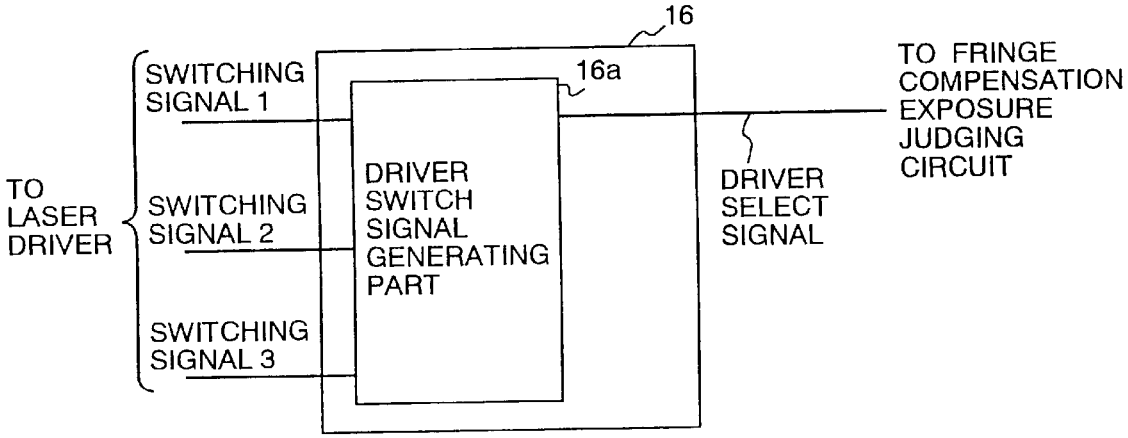
FIG. 12A is a block diagram of the SW16 shown in FIG. 6
FIG. 12B is a chart showing the states of operation of the SW16.

FIG. 12A shows an example of the switch SW16. In actual operation, one of the laser drivers 14, 15, 17 is selected to be driven, and a current drive switch signal-1, a current drive switch signal-2, and a current drive switch signal-3 for designating a driver to be operated are generated by driver selective signals, as indicated in FIG. 12B, from a fringe compensation exposure judging circuit.

Figure 14:
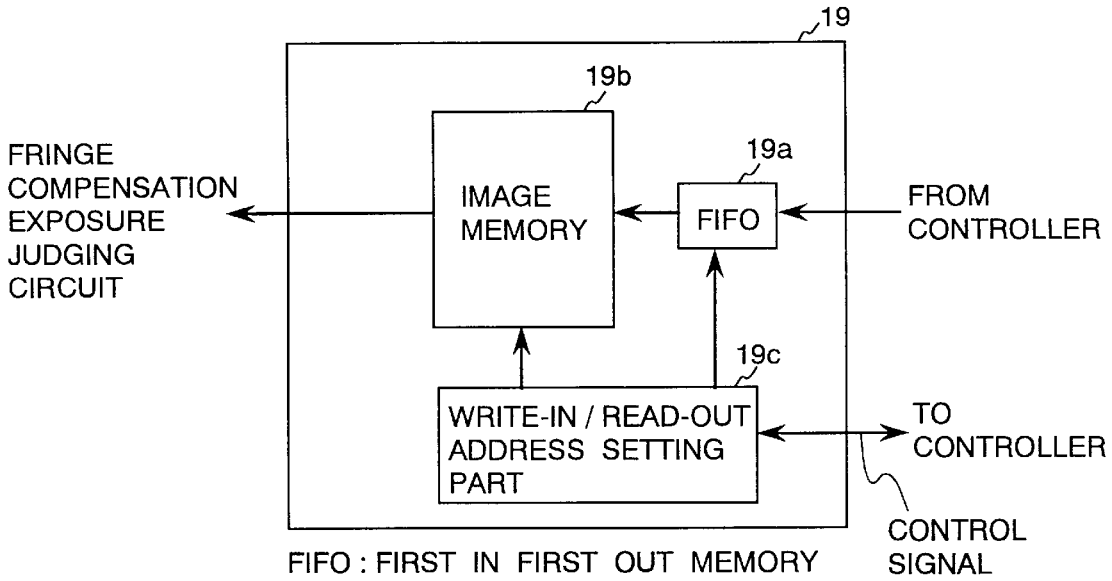
FIG. 14 is a block diagram of the image memory 19 shown in FIG. 7.

The reason why image memory 19 is necessary is because the appearance of the fringe is different for different print image patterns, thus peripheral information concerning the picture elements to be exposed is necessary for compensating the exposure. FIG. 14 shows details of the image memory 19. In order to operate the controller and the image memory asynchronously, the memory 19 is provided with a FIFO 19*a*. The data passing through the FIFO 19*a* is stored in the image memory 19*b*. The above operation is performed by write-in/read-out address setting unit 19*c* to effect handshake control with the controller.

Figure 13:
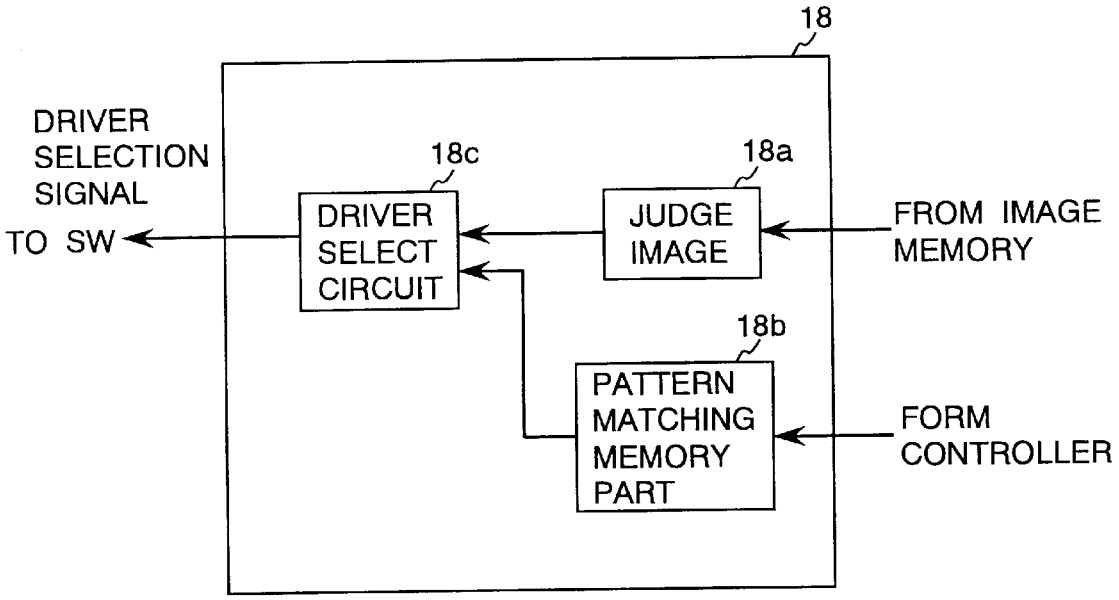
FIG. 13 is a block diagram of the fringe compensation exposure judging circuit shown in FIG. 7.

FIG. 13 shows the fringe compensation exposure judging circuit 18. An image input from the image memory 19 is input to the image judging input unit 18*a*. The image data format in the image judging unit 18*a* is updated at any time with a pattern of n*m (n,m:integer number) which locates a subject picture element (print picture element) in the center thereof. Because the appearance of the fringe is different for different print image patterns, as mentioned above, the pattern matching memory unit 18*b* first measures the appearance of the pattern, and then stores the kind of fringe control needed according to the kind of pattern, that is, the presence of the n*m pattern and the fringe control. The pattern matching is performed in this way, so that the necessity for fringe control can be judged in real time.

The data of the pattern matching memory unit 18*b* has a configuration that can be written in by the controller, and it has a flexible configuration that may easily be rewritten in response to a change in condition, such as due to the environment/degradation. The driver selective circuit 18*c* generates a signal for selecting the driver according to the judgment mentioned above.

It has been suggested as an example to use one laser driver for the fringe compensation in FIG. 7. By adding only one laser driver, it becomes possible to avoid the incremental addition of hardware. Furthermore, a system to change the laser driver, as in this embodiment, may be driven for high-speed printing.

As an approach which will not allow the picture quality to deteriorate, it is possible to provide a configuration in which an intermediate electric potential is provided relative to either of the regular and inverting potentials, such that one side avoids the fringe on the basis of the difference between the intermediate electric potential and the development bias, and the exposure control is performed only on the one side. By employing such a construction, it is possible to eliminate the fringe on both the normal side and the reverse side with minimum additional hardware.

FIG. 7 shows a configuration having one fringe compensation driver, although, of course, a configuration having two fringe compensation driver may be provided. By proving two fringe compensation drivers, the exposure control system may be applied to both normal and inverted pictures. By providing two additional laser drivers, although the hardware is increased a little, fringe compensation for both the normal and the reverse directions can be performed. However, the additional hardware in the developing side can be reduced. Further, the method of switching the laser drivers, as provided in this embodiment, can accommodate use with a high speed printer.

Furthermore, from the viewpoint of the overall system, a first developing unit has comparatively large freedom in design. This is because a second developing unit must be designed so as to not scrape toner which has been developed when developing is performed by the second developing unit, since development has been already performed by the first developing unit.

It is possible to design the first developing unit so as to have a large scraping force FR or to design a contact developing type (in this type the fringe development does not appear), though there is a problem as to its lifetime. By combining this and the electric potential distribution described above and idealizing, it is important to the provision of a system having better balance between performance and cost.

Further, as another embodiment of this construction, multi-level exposure may be performed using one driver. Although a multi-level driver is not suitable for a high speed printer, it is suitable for a low speed printer and is effective to reduce the need for additional hardware. Further, if analogue conversion exposure can be applied to an 8 bit digital input, it is possible to perform compensation exposure with a substantially high freedom.

Figure 8:
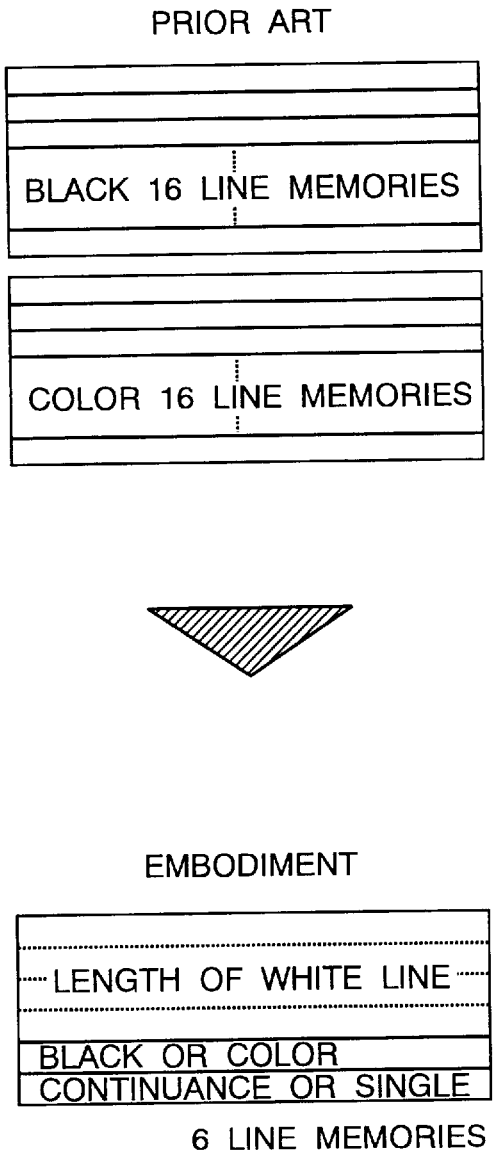
FIG. 8 is a diagram showing the constructions of memory areas.

FIG. 8 shows an example of a memory unit in the present embodiment. In a conventional system, nearly 20 lines of line memory for detecting an image are required in order to perform exposure control of a fringe in real time because the fringe appears within a width of several hundreds of micromillimeters from an edge portion of the image. Since the above information is required for two colors, the volume of the hardware becomes large and a problem of cost arises. On the other hand, in an example of the construction of the memory in this embodiment, since there are characteristics in the appearance of the pattern of the fringe, the volume of the memory is reduced by making use of the characteristics.

The characteristics of the appearance of the pattern of the fringe are as follows:

(1) The fringe appears especially strong in the rear end portion of an image.

(2) The fringe appears in a white image portion.

(3) A state of appearance of the fringe is different in a normal image and in a reverse image.

(4) A state of appearance of the fringe is different depending on an image pattern.

Therefore, the memory in this embodiment stores the above-mentioned characteristics and operates to suppress the fringe appearing in the rear end portion of an image.

The information to be stored is as follows:

(1) Objective pixels (pixels to be exposed) are a length of white pixels from a rear end portion of an image (zero when the objective pixels are image pixels).

(2) The kind of an image, that is, a normal image or a reverse image (the reason is that a state of appearing a fringe is different depending on electric potential distribution and developing condition).

(3) The kind of image information, that is, a continuous image or an isolated image.

By employing this construction, the volume of the hardware can be substantially reduced without degrading the quality of the exposure compensation.

It is obvious from FIG. 5 that the amount of fringe development is the largest in the rear end portion of an image, and the next largest appears in the right and the left portions, while the least appears in the front end portion. Needless to say, this control construction can cope with the fringes in the right and left portions, since the system has a line memory, though it cannot cope with a fringe in the front end portion.

By employing the above-mentioned measure, the fringes in the right and left portions also can be corrected by exposure control, and accordingly it is possible to distribute the margin more to the developing side. The above technique represents one of the examples for reducing the volume of the memory, although it is possible to consider other methods of storing various kinds of characteristics relating to the fringe development.

Figure 9:
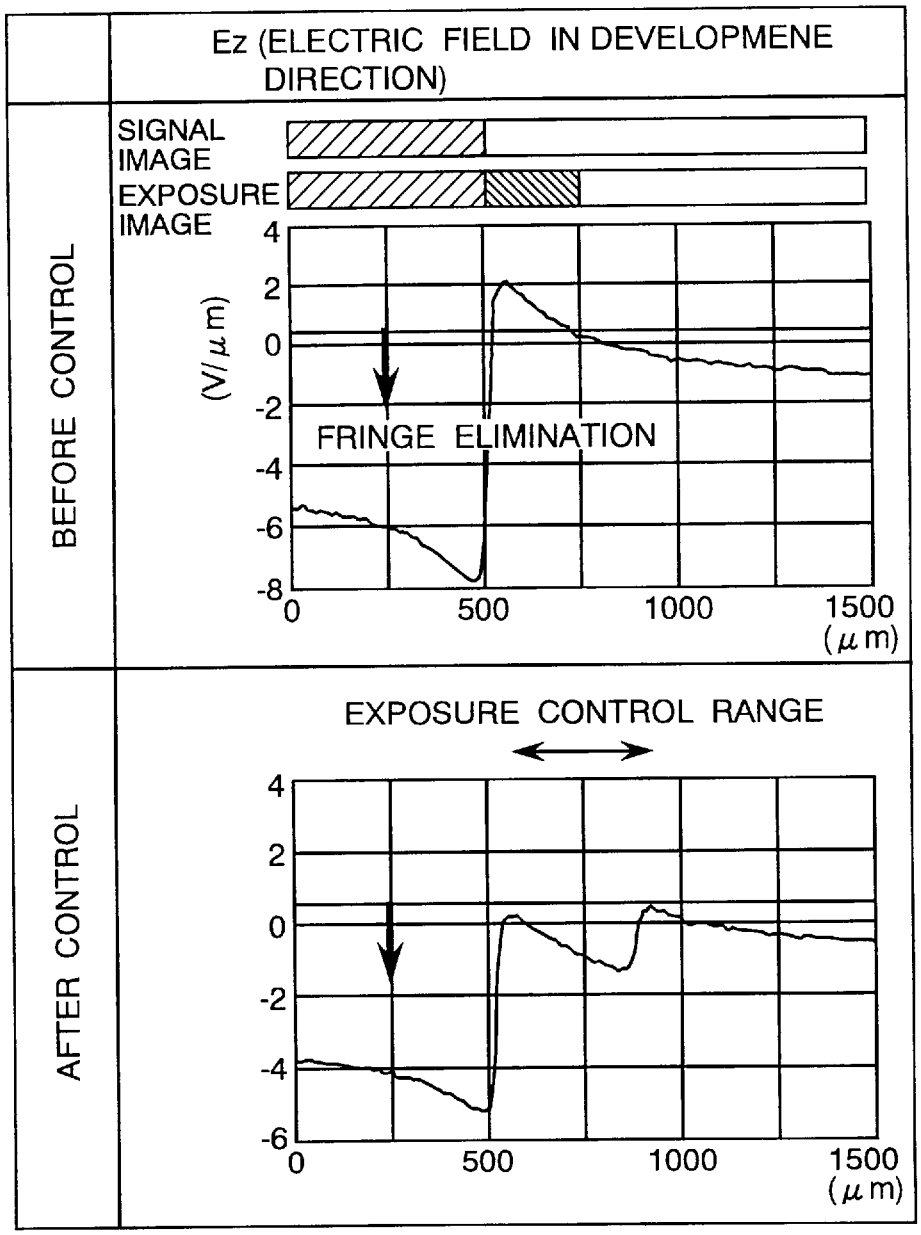
FIG. 9 is a chart for explaining simulations of exposure control.

FIG. 9 is a chart of the simulation result showing an effect of the exposure control under a certain developing condition. The abscissa in the graph included in the chart indicates position and the ordinate indicates the intensity of the electric field in the direction of development. The objective image is a rear end portion of a full solid image, and, as shown in the figure, before control, the image changes from a reverse image to a white one. In this case, the opposite charged toner is developed in a portion above an electric field for fringe elimination due to enhancement of an edge portion. It can be understood from the figure that, after control, the electric field can be controlled so as to be decreased below the electric field of fringe elimination by performing exposure control to project a certain quantity of light onto a certain range.

The appearance of the fringe is prevented by increasing the electric potential difference from the intermediate electric potential to the developing bias, and it has been found that the electric potential difference described above can be reduced to 50% by using the present exposure control.

An optimum exposure condition in this case is a range to be exposed to a fringe appearance zone of 1–1.7 times the fringe appearance width, and the quantity of exposure is 1.05–1.7 times the exposure for an intermediate electric potential.

By knowing the above-mentioned compensation conditions, exposure compensation can be easily performed, and the contents of exposure control to be performed next can be easily estimated when the developing condition has changed.

In a case where the exposure control in accordance with the present invention is not used, a toner carrier having a substantially low resistivity will have to be used. However, by using the exposure control in accordance with the present invention, it is possible to use a highly resistive and long lifetime carrier, such as ferrite, magnetite or the like, as the base material. By employing such a carrier, there is no need to use a special developing agent, and, accordingly, there is an advantage in cost. Further, the above-mentioned carrier is advantageous in having a longer lifetime, and, accordingly, there is an added advantage when applying it to a heavy-duty printer.

By employing exposure control in accordance with the present invention, it is possible to perform printing while suppressing the fringe phenomenon. By employing the memory structure in accordance with the present invention, it is possible to realize a control construction requiring a smaller volume of memory.

What is claimed is:

1. A method of controlling light exposure for an electrophotographic apparatus using a tri-level developing method for exposing a photosensitive body provided in the electrophotographic apparatus, comprising the steps of:

changing the photosensitive body with at least two voltage levels corresponding to two colors of toners and with a middle voltage between the at least two voltage levels;

suppressing the appearance of a fringe by weakening a reverse electric field producing the fringe around an image portion using an exposure control means; and developing the photosensitive body.

2. A method of controlling light exposure for an electrophotographic apparatus using a tri-level developing method, comprising the steps of:

suppressing the appearance of a fringe by weakening a reverse electric field producing the fringe around an image portion using an exposure control means;

wherein information based on a fringe characteristic is used as judging information for determining exposure control.

3. A method of controlling light exposure for an electrophotographic apparatus using a tri-level developing method, comprising the steps of:

suppressing the appearance of a fringe by weakening a reverse electric field producing the fringe around an image portion using an exposure control means;

wherein a balance of a scraping force FR of a developing agent scraping a photosensitive body and an electric field force satisfies a condition $6<(FR+qEy)/qEz<10$, wherein qEy means electric field force in a direction of scraping, qEz means electric field in a direction of developing, and q means quantity of charge of toner.

4. A method of controlling light exposure for an electrophotographic apparatus using a tri-level developing method, comprising the steps of:

suppressing the appearance of a fringe by weakening a reverse electric field producing the fringe around an image portion using an exposure control means;

wherein a range to be exposed to a fringe apparatus zone is 1–1.7 times that of the fringe appearance width, and the quantity of exposure is 1.05–1.7 times that of an exposure for an intermediate electric potential.

5. A method of controlling light exposure for an electrophotographic apparatus using a tri-level developing method, comprising the steps of:

suppressing the appearance of a fringe by weakening a reverse electric field producing the fringe around an image portion using an exposure control means;

wherein only one level of surface electric potential is used as data for exposure control.

6. A method of controlling light exposure for an electrophotographic apparatus according to claim 1, wherein ferrite and magnetite are used as a base material of a carrier of the toner.

* * * * *